US009696113B2

(12) United States Patent
Tedder et al.

(10) Patent No.: US 9,696,113 B2
(45) Date of Patent: Jul. 4, 2017

(54) IMPLEMENT HOLSTER

(71) Applicant: Tedder Industries, LLC, Hayden, ID (US)

(72) Inventors: Thomas Tedder, Hayden, ID (US); Timothy Treto, Mead, WA (US)

(73) Assignee: TEDDER INDUSTRIES, LLC., Hayden, ID (US)

( * ) Notice: Subject to any disclaimer, the term of this patent is extended or adjusted under 35 U.S.C. 154(b) by 176 days.

(21) Appl. No.: 14/620,506

(22) Filed: Feb. 12, 2015

(65) Prior Publication Data

US 2016/0238342 A1 Aug. 18, 2016

(51) Int. Cl.
*F41C 33/02* (2006.01)

(52) U.S. Cl.
CPC ..... *F41C 33/0263* (2013.01)

(58) Field of Classification Search
CPC ..... F41C 33/0227; F41C 33/0263; A45F 2200/0591
USPC ..... 224/243, 247, 256, 912
See application file for complete search history.

(56) References Cited

U.S. PATENT DOCUMENTS 1,917,844 A * 7/1933 Keith ..... F41C 33/0209 224/193
3,630,420 A * 12/1971 Bianchi ..... F41C 33/0209 224/193
4,971,236 A * 11/1990 Grummet ..... F41C 33/0209 224/193
5,269,448 A * 12/1993 Shoemaker ..... F41C 33/0227 224/243
5,421,497 A * 6/1995 Gilmore ..... A45F 5/00 224/192
5,551,611 A * 9/1996 Gilmore ..... A45F 5/00 224/192
6,085,951 A * 7/2000 Beletsky ..... F41C 33/0227 224/242
6,398,089 B1 * 6/2002 Har-Shen ..... F41C 33/0209 224/192
6,547,111 B2 * 4/2003 French ..... F41C 33/0227 224/244
6,604,657 B2 * 8/2003 Yirmiyahu ..... F41C 33/0227 224/243
7,258,259 B1 * 8/2007 Owens ..... A45F 5/02 224/192
7,461,765 B2 * 12/2008 French ..... F41C 33/0227 224/238
7,841,497 B1 * 11/2010 Gregory ..... F41C 33/0263 224/243
7,922,050 B2 * 4/2011 Beneš ..... F41C 33/0227 224/192
8,096,453 B2 * 1/2012 Lowe ..... F41C 33/0209 224/243

(Continued)

*Primary Examiner* — Brian D Nash
(74) *Attorney, Agent, or Firm* — Timberline Patent Law Group

(57) ABSTRACT

Representative implementations of devices and techniques provide a holster for a weapon, tool, or other implement. The holster comprises a backing that may be combined with one or more interchangeable shell components (i.e., covers) to at least partially encase the implement. The backing includes a recessed portion, and a retention membrane is coupled to the backing to form a cavity with the recessed portion. The membrane is arranged to flex partially into the cavity when the implement is encased within the holster.

27 Claims, 8 Drawing Sheets

(56) References Cited

U.S. PATENT DOCUMENTS

| | | | | |
|---|---|---|---|---|
| 8,109,420 | B2 * | 2/2012 | Martinez | A45F 5/02 224/197 |
| 8,973,799 | B2 * | 3/2015 | Ruiz, III | F41C 33/048 224/192 |
| 9,301,595 | B2 * | 4/2016 | Tedder | A45F 5/00 |
| 2002/0047029 | A1 * | 4/2002 | Liao | F41C 33/0209 224/244 |
| 2005/0127121 | A1 * | 6/2005 | Wells | F41C 33/0236 224/193 |
| 2013/0181021 | A1 * | 7/2013 | Yarbrough | F41C 33/0263 224/244 |
| 2014/0097216 | A1 * | 4/2014 | Rogers | F41C 33/046 224/243 |
| 2015/0034684 | A1 * | 2/2015 | Tedder | A45F 5/00 224/242 |
| 2015/0247701 | A1 * | 9/2015 | Faifer | F41C 33/0209 224/244 |
| 2015/0345899 | A1 * | 12/2015 | Bardy | F41C 33/0236 224/243 |
| 2016/0066680 | A1 * | 3/2016 | Hazeltine | A45F 5/021 224/676 |
| 2016/0216065 | A1 * | 7/2016 | Tedder | F41C 33/0263 |

* cited by examiner

IMPLEMENT HOLSTER

BACKGROUND

Implements, such as tools, weapons, and the like, may be encased in a holster for protection of the implement and/or the user, while providing access to the implement. For example, a holster may allow a user to conveniently carry the implement, safely retaining the implement until needed. When the implement is to be used, the user may withdraw the implement from the holster, and then return it to the holster when finished.

In the case of a handgun, the holster should reasonably protect the handgun and the user, and should be convenient to the user for ready use. Accordingly, the holster should retain the handgun until it is to be used, but allow the user to draw the handgun for use without undue effort or difficulty. The holster should be rigid and stable enough to allow the handgun to be repeatedly drawn and reholstered, usually with the same hand. However, the holster should also be flexible enough to be comfortably carried by the user, such as when it is worn on the person of the user for an extended length of time. It can be challenging to balance each of these characteristics.

Often a user may be constrained to select a holster that satisfies some of the desired characteristics (e.g., protection, convenience, retention, access, stability, comfort, etc.), but at a sacrifice to others of the characteristics. Accordingly, some users may purchase multiple holsters, even for the same handgun (or other implement), where each of the holsters satisfies a different set of desired characteristics (and sacrifices others). This may be particularly true for a user who desires to carry a handgun in multiple different locations or configurations on the user's person at different times.

BRIEF DESCRIPTION OF THE DRAWINGS

The detailed description is set forth with reference to the accompanying figures. In the figures, the left-most digit(s) of a reference number identifies the figure in which the reference number first appears. The use of the same reference numbers in different figures indicates similar or identical items.

For this discussion, the devices and systems illustrated in the figures are shown as having a multiplicity of components. Various implementations of devices and/or systems, as described herein, may include fewer components and remain within the scope of the disclosure. Alternately, other implementations of devices and/or systems may include additional components, or various combinations of the described components, and remain within the scope of the disclosure. Shapes and/or dimensions shown in the illustrations of the figures are for example, and other shapes and or dimensions may be used and remain within the scope of the disclosure, unless specified otherwise.

DETAILED DESCRIPTION

Introduction

Figure 1:
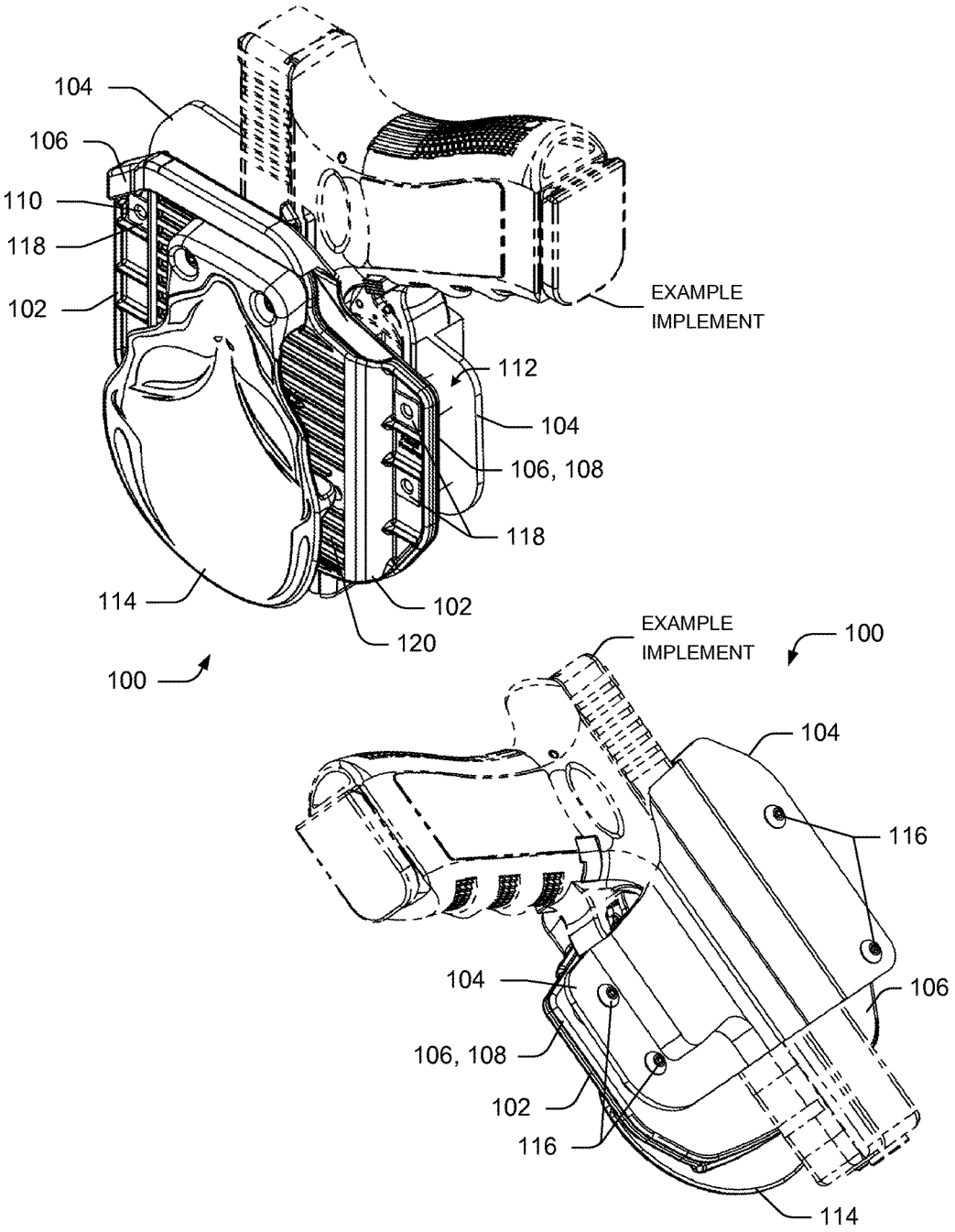
FIG. 1 includes two perspective views of an example holster assembly, according to an embodiment.

Representative implementations of devices and techniques provide a holster for a weapon, tool, or other implement. The holster comprises a backing that may be combined with one or more interchangeable shell components (i.e., covers) to at least partially encase the implement.

In one example, the backing and the cover form a holster that at least partially encases the implement within the holster. In an embodiment, the holster includes an attachment portion, which may be attached (using a paddle, belt slide, or modular coupler, for instance) to an article or garment of the user, for carrying or wearing the holster in various configurations by the user. In some embodiments, the mounting configurations may be adjustable for user preference of holster mounting angle, height, and so forth.

In one embodiment, the backing includes a recessed portion. In the embodiment, a retention membrane is coupled to the backing to form a cavity with the recessed portion. In another embodiment, multiple retention membranes are coupled to the backing to form the cavity. The membrane(s) are arranged to flex partially into the cavity when the implement is encased within the holster, providing retention to the implement while it is holstered.

In an implementation, the backing includes an adjustable paddle, belt slide, or modular mounting component releaseably and interchangeably coupled to the backing and arranged to secure the holster to an article or garment of a user in multiple configurations. For example, the paddle, belt slide, or modular mounting component may be interchanged and/or adjusted to various positions or configurations by the user. In an embodiment, the paddle, belt slide, or modular coupler is adjustable to change a relative position of the holster with respect to the paddle, belt slide, or modular coupler, including forward, neutral, and reverse carry positions. In various implementations, the paddle (shown in FIG. 4) fits inside the waistband of a pair of trousers, for example, holding the holster (which is outside the waistband) in place on the user's person. The belt slide (shown in FIG. 5) fits around a belt or strap worn by the user and the modular coupler (not shown) allows the holster to be coupled to various modular connectors attached to a garment, object, or article of the user.

For example, the modular coupler allows the holster to be quickly attached to a belt or strap at the waist, thigh, shoulder, ankle, etc. of the user. Additionally, the modular coupler allows the holster to be quickly attached to a vehicle interior component, a desk, a nightstand, or other object. In an embodiment, the user can attach the holster to a belt or strap worn by the user while carrying the holster, and quickly remove the holster from the belt or strap, and attach the holster to an interior portion of a vehicle while driving or attach the holster to a desk or nightstand while at the office or at home, using the modular coupler.

In an implementation, the holster includes one or more bushings or spacers arranged to space (e.g., offset) the cover from the backing, to determine a retention of the holster. In one embodiment, the spacers comprise user-adjustable tensioner components that allow the user to adjust the retention of the holster. In an alternate embodiment, the spacers may be molded into a surface of the cover or other holster component (e.g., backing, membrane, etc.).

In one example, the backing, the cover, and/or other holster components (e.g., membrane, paddle, slide, etc.) may be partially or fully molded using an injection molding process, or the like. Injection molding the holster components allows the various components to be formed in a desired shape and configuration, and allows for the customization of the components and the holster, if desired. Further, injection molding the backing and/or cover (and/or other parts of the holster) allows for custom finishes, better quality finishes, a simpler manufacturing process, the addition of features to improve performance (e.g., retention, durability, etc.), and reduced cost.

In an implementation, the backing, cover, or other components may be formed to include one or more features molded onto a surface of the component. For example, features may be used for tuning a relative friction of the surface of the component, based on a shape and/or an orientation of the features. In some embodiments, the retention of the holster (as well as the drawing and reholstering action) may be tuned based on features molded into the backing, retention membrane, and/or the cover. In other embodiments, the friction of the holster against articles or garments, or against the person of the user, may be tuned using molded-in features on a surface of components (e.g., backing, paddle, slide, etc.) of the holster. This may be helpful for user comfort or for grip of the holster on articles or garments, for instance. Further, molded-in features may be arranged to engage one or more portions of the implement to assist with retention or alignment of the implement within the holster.

Techniques and devices are discussed with reference to example handgun holsters illustrated in the figures. However, this is not intended to be limiting, and is for ease of discussion and illustrative convenience. The techniques and devices discussed may be applied to any of various cases, case designs, combinations, and the like, (e.g., holsters, sheaths, covers, cases, carriers, scabbards, etc.) for encasing tools, weapons, or other implements, and remain within the scope of the disclosure.

Further, the techniques and devices are discussed and illustrated generally with reference to an outside waistband (OWB) paddle style holster. This is also not intended to be limiting. In various implementations, the techniques and devices may be employed with inside waistband (IWB) holsters, as well as holsters worn at the back, chest, side, thigh, or ankle of a user, holsters carried in a bag, purse, or pocket, or carried or worn on a belt, a strap, or in any other manner (e.g., attached to a vehicle, an object of furniture, another object, etc.). In alternate implementations, the techniques and devices may be employed in other ways or with other devices, systems, instruments, or the like.

Implementations are explained in more detail below using a plurality of examples. Although various implementations and examples are discussed here and below, further implementations and examples may be possible by combining the features and elements of individual implementations and examples.

Example Holster

Referring to FIGS. 1 through 6, an example holster 100 is shown in several non-limiting example configurations. In various embodiments, as shown in the FIGS. 1-6, a backing 102 is combined with a cover 104, for example, to form the implement holster 100 (as shown in FIG. 1, for instance). In an implementation, the backing 102 comprises a first shell component and the cover 104 comprises a second shell component. In the implementation, the holster 100 is formed by coupling the first and second shell components, which are modular shell sections (half-shells or shell portions, for example). In an embodiment, the cover 104 is releaseably coupled to the backing 102 in a modular fashion.

Figure 2:
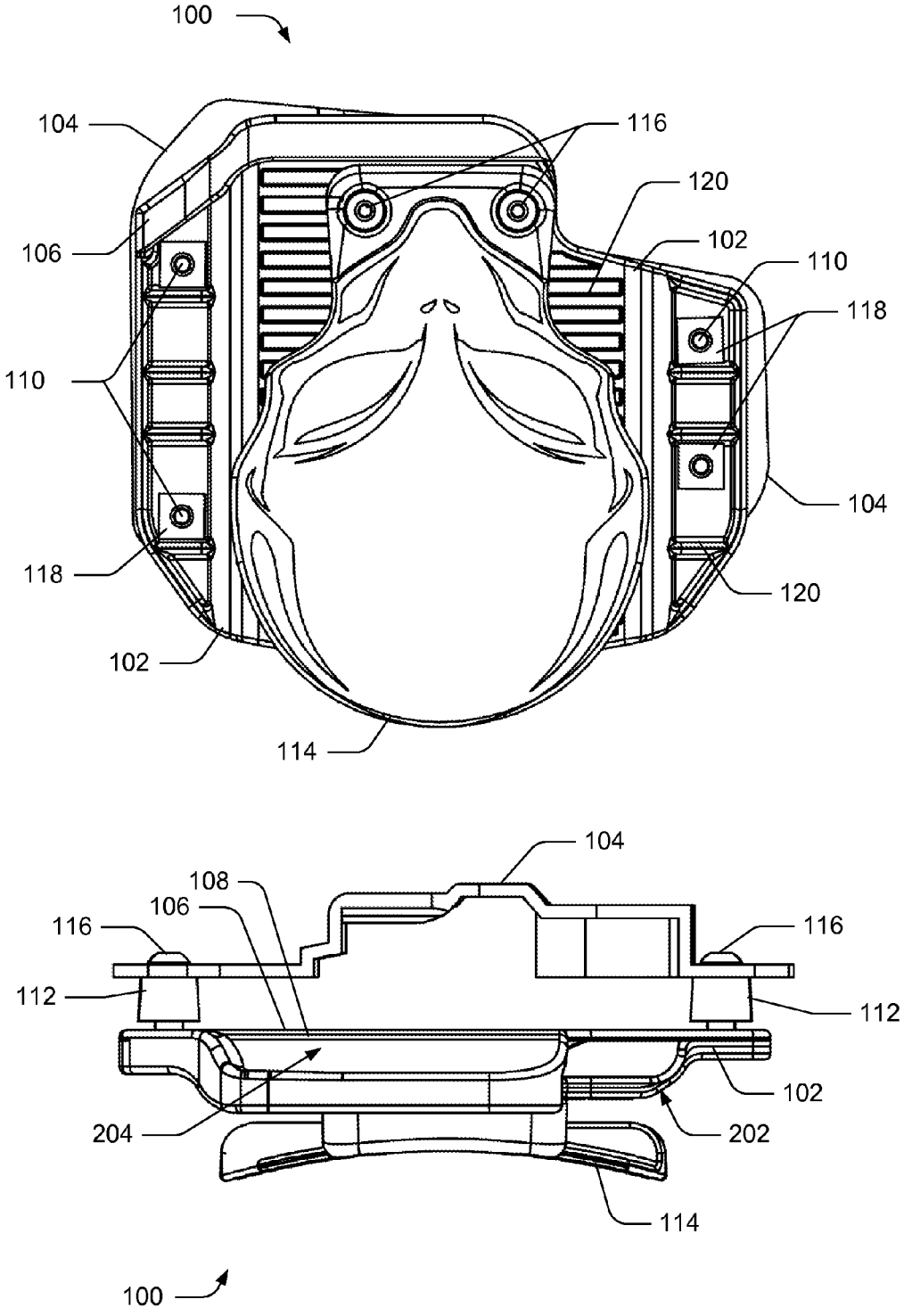
FIG. 2 includes a plan view and a profile view of the holster assembly of FIG. 1, according to an embodiment. The profile view includes some cross-section illustration, showing some details.
Figure 3:
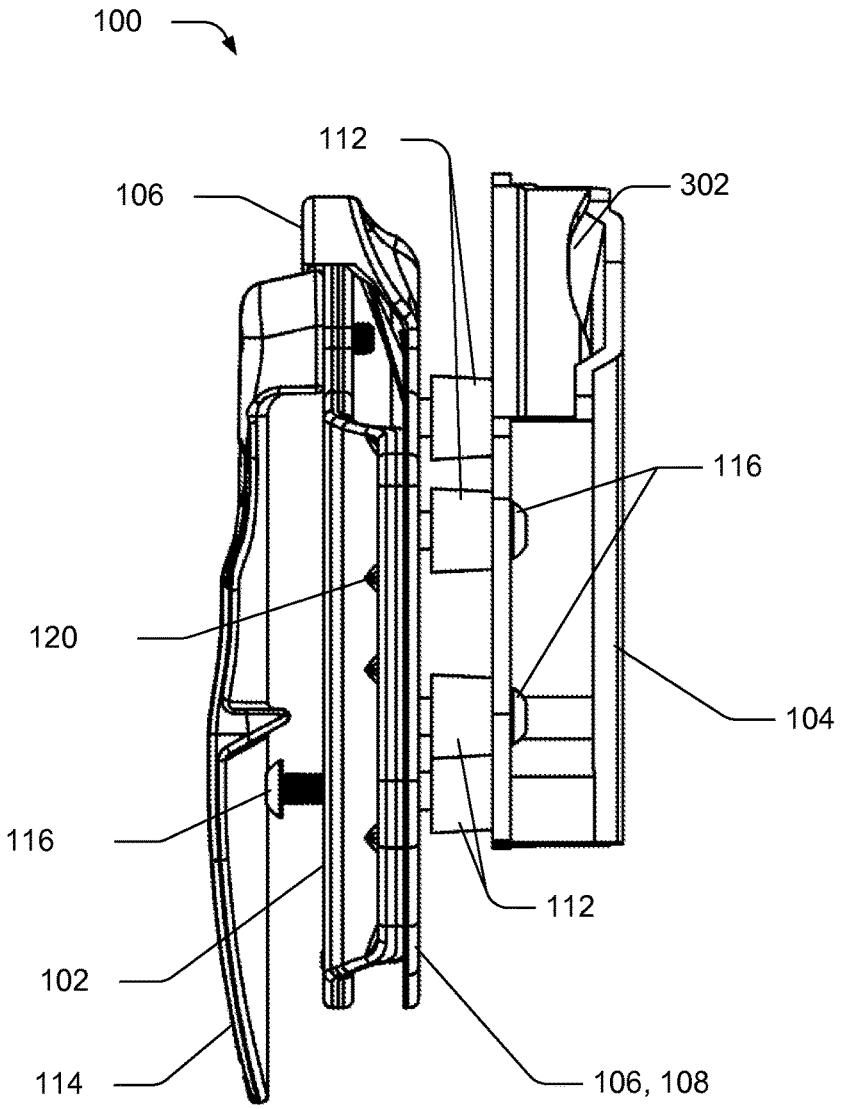
FIG. 3 is a side view of the example holster assembly of FIG. 1, including some cross-section illustration showing some details, according to one embodiment.
Figure 4:
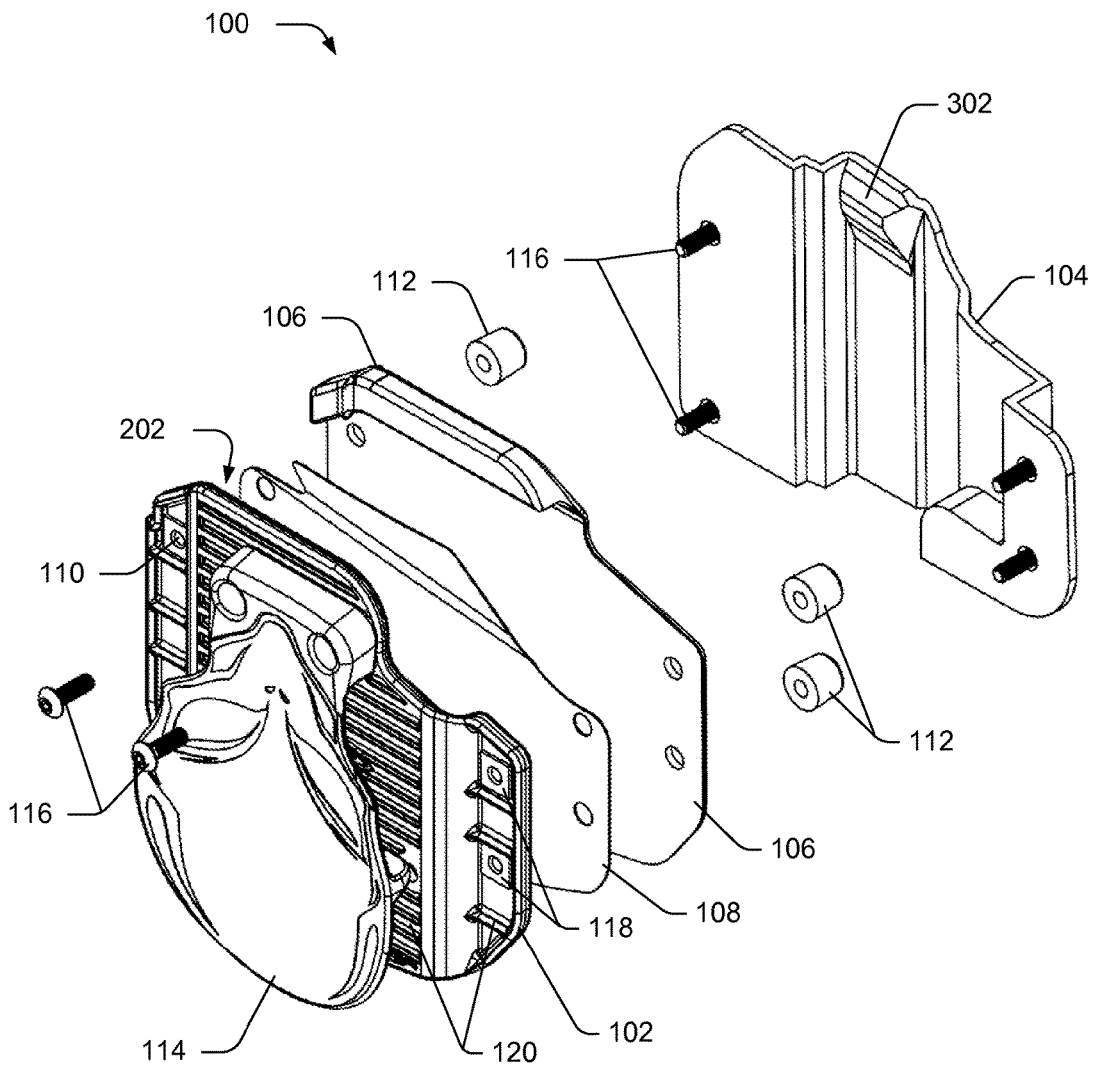
FIG. 4 is an exploded perspective view of an example holster assembly with a releasable paddle component, according to one embodiment.
Figure 6:
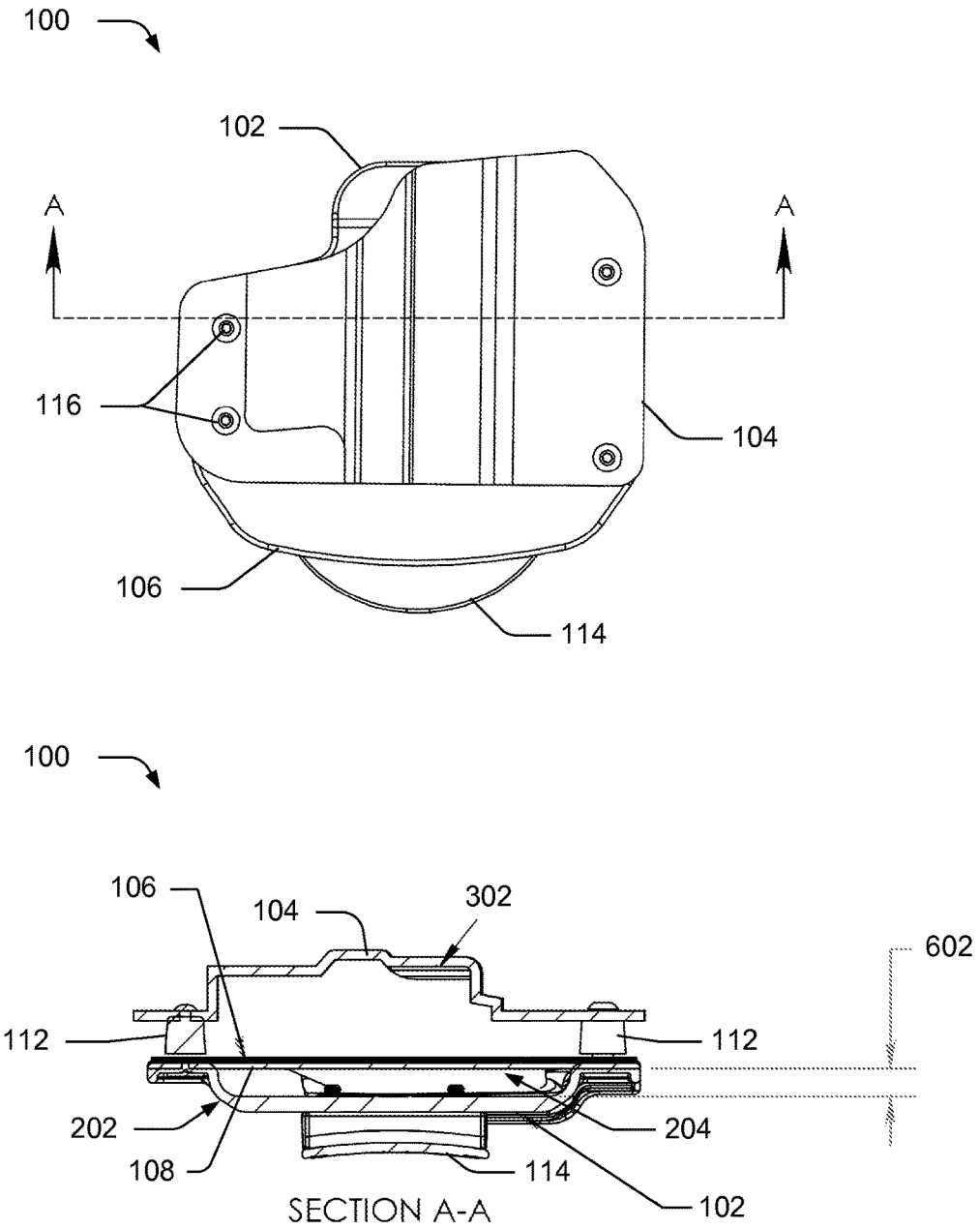
FIG. 6 is a plan view and a section view of an example holster assembly, showing an example cavity area, according to an embodiment.

In an implementation, as shown in FIGS. 2, 4, and 6, the backing 102 includes a recessed portion 202. In the implementation, a flexible or semi-flexible sheet (i.e., retention membrane) 106 is coupled to the backing 102. In various embodiments, a single retention membrane 106 or multiple retention membranes 106, 108 are used to provide desired retention, stiffness, durability, flexibility, etc. For example, the membrane(s) 106, 108 may be coupled to the backing 102 such that it covers part or the entire recessed portion 202, forming a cavity 204 with the backing 102. The depth of the cavity 204 can be shown by the gap 602 (shown in FIG. 6), which is the greatest distance of the membrane 106, 108 from the recessed portion 202 of the backing 102. In various embodiments, the distance (or depth) of the gap 602 may be varied to accommodate different implements.

In an embodiment, the cover 104 and the membrane(s) 106, 108 encase the implement, or at least a portion of the implement, when the implement is holstered. As the implement is holstered, the implement is pushed against the membrane(s) 106, 108, causing the membrane(s) 106, 108 to be extended into the cavity 204. In other words, the membrane(s) 106, 108 flex at least partially into the cavity 204 when the implement is holstered.

In various embodiments, the membrane(s) 106, 108 are able to flex into the cavity 204 toward the backing 102 a distance up to the distance of the gap 602. When the membrane(s) 106 flex, it causes the membrane(s) 106, 108 to be in a state of tension. In the embodiments, the membrane(s) 106, 108 push back against the implement, and provide retention of the implement within the holster 100. When the implement is removed from the holster 100, the membranes(s) 106, 108 relax and return to a former position with respect to the backing 102. In an implementation, the backing 102 provides structure (rigid or semi-rigid) for the holster 100, supporting the membrane(s) 106, 108, and provides the recessed portion 202 for the membrane(s) 106, 108 and to form the cavity 204. In some implementations, the backing 102 may encase a portion of the implement as well.

In an implementation, the backing 102 and/or the cover 104 are partially or fully formed using an injection molding process. Accordingly, the backing 102 and/or cover 104 (and thus the holster 100) can be custom molded as desired for the user and/or as needed for holstering an implement, such as the example implement of FIG. 1, for instance. In another implementation, one or more of the membranes 106, 108 are partially or fully formed using an injection molding process. In alternate implementations, one or more of the backing 102, membrane(s) 106, 108, and the cover 104 are formed by some other process (e.g., stamping, cutting, etc.).

In an implementation, the cover 104 comprises a removable, modular plastic shell section formed using an injection molding process to conform to the shape of at least a portion of the implement. Further, in various embodiments, the backing 102, membrane(s) 106, 108, and/or cover 104 are custom molded to at least partially encase the implement. For example, the backing 102, membrane(s) 106, 108, and/or cover 104 may be molded in various shapes and sizes to accommodate a particular implement, or a range of implements. For example, the backing 102, membrane(s) 106, 108, and/or cover 104 may be shaped and sized to accommodate a particular model of handgun, or a series of handguns.

In various implementations, the backing 102, one or more of the membranes 106, 108, and/or the cover 104 are comprised of one of various plastics, or the like. For example, the backing 102, one or more of the membranes 106, 108, and/or the cover 104 may comprise a thermoplastic elastomer (TPE), or similar material. In alternate implementations, the backing 102, one or more of the membranes 106, 108, and/or the cover 104 comprise other materials (e.g., animal hide, composite, metal, etc.) or a combination of materials. In an example, one or more of the membranes 106, 108 may comprise a spring-type metal layer, comprising stainless steel, titanium, or another metal or alloy.

The use of an injection molded TPE provides a flexible backing 102, membrane 106, and/or cover 104, that is also rigid and stable for drawing and reholstering the implement with the same hand, for instance. In various embodiments, the backing 102, membrane 106, and/or cover 104 have flexibility and stability properties based on a particular TPE material selected and a thickness of the backing 102, membrane 106, and/or cover 104. In some embodiments, the membranes 106, 108 have flexibility and stability properties based on the materials selected for each layer 106, 108 and the thickness of each layer 106, 108.

Some TPE materials that may be used to form a molded backing 102, membrane 106, 108, and/or cover 104 include styrenic block copolymers (TPE-s), polyolefin blends (TPE-o), elastomeric alloys (TPE-v or TPV), thermoplastic polyurethanes (TPU), Thermoplastic copolyesters, thermoplastic polyamides, combinations of the same, and the like.

In an implementation, the backing 102 and/or membrane(s) 106, 108 comprise a moisture barrier and/or a corrosion barrier between a user and the implement. For example, the backing 102 and/or membrane(s) 106, 108 form a moisture-proof barrier against the perspiration of the user, which may tarnish, or otherwise corrode the implement, while the holster 100 is being worn by the user. In other implementations, the backing 102 and/or membrane(s) 106, 108 comprise a protection for the user or the user's clothing against abrasion, heat, or jabbing by the implement.

Figure 5:
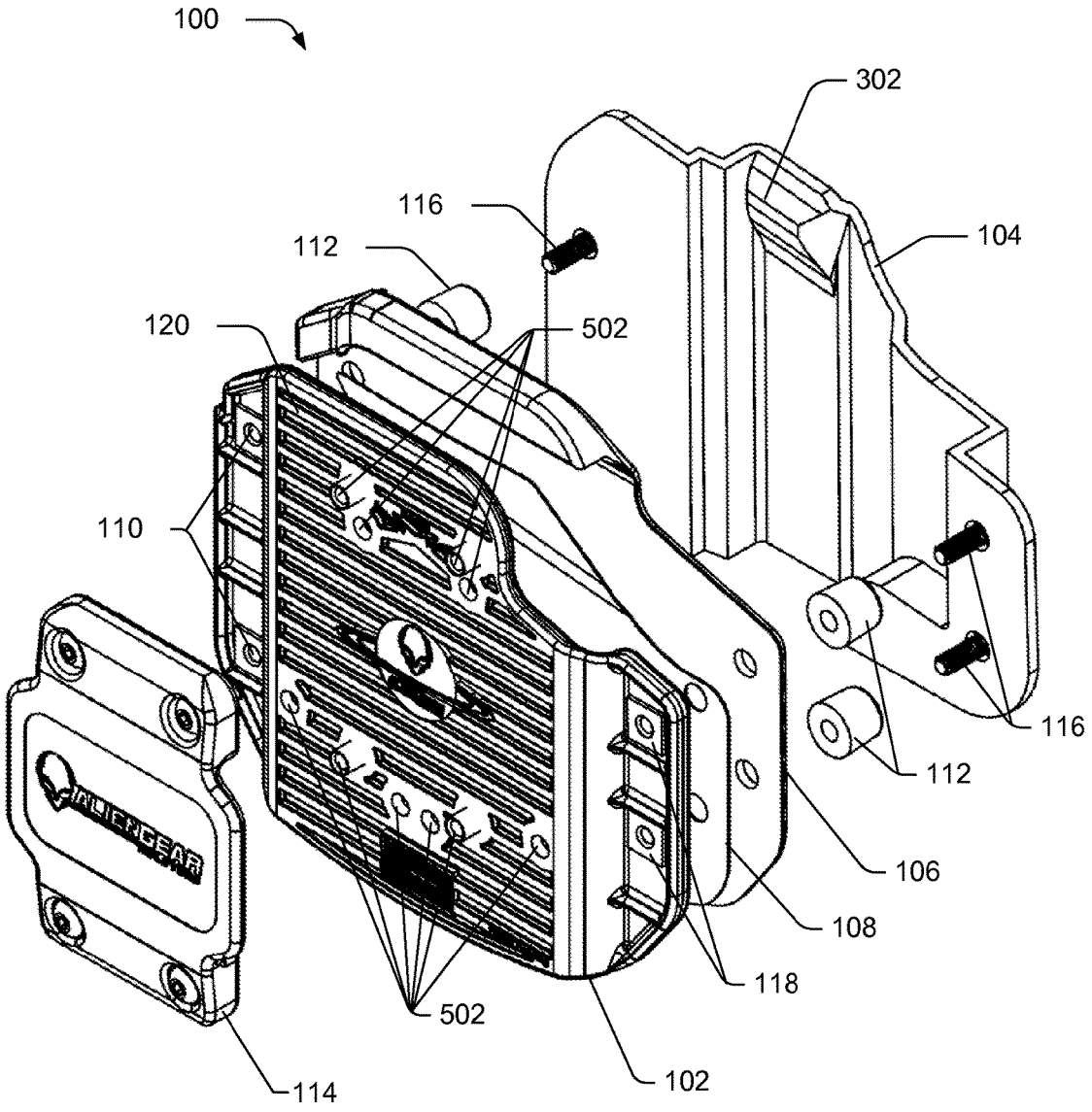
FIG. 5 is an exploded perspective view of an example holster assembly with a releasable slide component, according to another embodiment.

In an implementation, as shown in FIGS. 1-6, the backing 102, membranes 106, 108, and the cover 104 include one or more cover fastener locations 110, arranged for coupling a cover 104 to the backing 102. In an example, the cover fastener locations 110 comprise discrete locations for attaching the cover 104 and adjusting the retention of the holster 100 (based on a spacing of the cover 104 from the backing 102, for instance). Further, the backing 102 includes one or more attachment fastener locations 502 (as shown in FIG. 5), arranged for coupling mounting fixtures 114 to the backing 102, such as paddles, slides, clips, modular couplers, and the like.

In an embodiment, the cover fastener locations 110 and/or the attachment fastener locations 502 include molded or drilled holes that extend partially or fully through the backing 102, and may extend through one or more other layers, if present. In an alternate embodiment, the cover fastener locations 110 and/or the attachment fastener locations 502 include molded sleeves, molded guides, or other protrusions to assist in locating, guiding, or spacing fasteners to be inserted into the holes 110, 502, or the like.

In an implementation, as shown in FIGS. 1-6, the holster 100 includes one or more bushings 112 (e.g., spacers) located at attachment points between the backing 102 and the cover 104 and arranged to space the cover 104 from the backing 102 to determine a retention of the holster 100. For example, the bushings 112 may include offset bushings, spring tensioners, washers, lock mechanisms, spacers, or the like. In an embodiment, the spacers 112 comprise adjustable tension devices arranged to be user-adjusted to determine the retention of the holster 100. In one implementation, the bushings 112 are molded into the backing 102 and/or the cover 104. For example, in an embodiment, the bushings 112 are integrated to the backing 102 and/or cover 104 as part of molding or forming of the backing 102 and/or cover 104.

In an implementation, the holster 100 includes one or more fasteners 116, 118 located to couple the cover 104 to the backing 102. For example, the cover 104 may be positioned to at least partially encase a carried implement within the holster 100, and can be fixed to the backing 102 using one or more fasteners 116, 118. In various implementations, fasteners 116, 118 may include mechanical devices such as T-nuts, rivets, screws, Chicago screws, or the like, or a combination of the same.

In an implementation, as illustrated in FIGS. 1-6, the fasteners 116, 118 have multiple components (e.g., a first component 116 and a second component 118, for example) that fit together to temporarily or permanently join the cover 104 to the backing 102. In various examples, the fasteners 116, 118 comprise snap-type fasteners, screw and nut fasteners, or the like.

Additionally, the backing 102 may include one or more of the fasteners 116, 118 to couple one or more mounting fixtures 114 to the backing 102. The mounting fixtures 114 may be positioned to attach the backing 102 (and thus the holster 100) to an article or garment of a user, so that the holster 100 may be worn or carried by the user, for instance. For example, the mounting fixtures 114 may include modular mounting components, paddles, slides, clips, straps, loops, J-clips, C-clips, keepers, or other devices for mounting the holster 100 on a belt, strap, trouser, or other article or garment.

In an implementation, at least one component (e.g., the first 116 or the second 118) of the fasteners 116, 118 is molded into/onto the backing 102 and/or the cover 104. In an embodiment, the fasteners 116, 118 are integrated to the backing 102 and/or cover 104 as part of molding or forming of the backing 102 and/or cover 104. In one example, the first fastener component 116 is molded into the cover 104 and the second fastener component 118 is molded into the backing 102 (or vice versa). In alternate examples, only a first (116) or a second (118) fastener component is molded into the backing 102 or the cover 104, with the other component (116 or 118) being loose. In other examples, various combinations of the same are included.

FIGS. 1 and 2 illustrate one example of a second fastener component 118 that may be molded into the backing 102. As shown, the second fastener component 118 may be molded into the backing 102 at the cover fastener locations 110. Alternately, the second fastener component 118 may be molded into the backing 102 at the attachment fastener locations 502. In some embodiments where the second fastener component 118 is molded into the backing 102, the first fastener component 116 may be loose, and in other embodiments, the first fastener component 116 may be molded into the cover 104. In alternate embodiments, the first 116 and second 118 fastener components may be molded into the backing 102 and/or cover 104, or be loose, in various combinations as described above.

In an implementation, the fasteners 116, 118 comprise releasable fasteners, and are arranged to removeably couple one of a multiplicity of covers 104 to the backing 102 in a modular fashion, to carry one of a multiplicity of implements with the holster 100. For example, the holster 100 may include one or more interchangeable cover shell sections arranged to be releaseably coupled to the backing 102 and interchanged with the second shell component (i.e., cover 104) to encase at least a portion of one or more different implements. In the example, a user may remove a first cover 104 from the backing 102 and replace it with a second or third cover 104 to use the holster for carrying the different implements. In such an example, each cover 104 may be molded to the shape of a specific implement or a range of implements.

Additionally or alternately, the fasteners 116, 118 comprise releasable fasteners arranged to removeably couple a multiplicity of mounting fixtures 114 to the backing 102 for versatility in carrying or wearing the holster 100. For instance a user may remove a first mounting fixture 114 (such as a paddle, as shown in FIG. 4 for example) from the backing 102 and replace it with a second mounting fixture 114 (such as a belt slide, as shown in FIG. 5 for example) to change the manner or location that the holster 100 is carried or worn by the user.

In an embodiment, as shown in FIG. 5, the backing 102 includes multiple attachment fastener locations 502, and the one or more adjustable mounting fixtures 114 can be coupled to various ones of the attachment fastener locations 502 to provide multiple configurations for carrying or wearing the holster 100. For example, the ride height and/or the cant of the holster 100 may be configured or adjusted by moving a mounting fixture 114 (or multiple mounting fixtures 114) from a first attachment fastener location 502 to a second attachment fastener location 502, or from a first set of attachment fastener locations 502 to a second set of attachment fastener locations 502 (when more than one fastener location 502 is used to secure a mounting fixture 114 to the backing 102).

Referring to FIGS. 1-6 and 8, in an implementation, the cover 104, one or more of the membranes 106, 108, and/or the backing 102 include one or more features, such as features 120, 302, and 802 for example, molded into at least a portion of a surface of the cover 104, a surface of one or more of the membranes 106, 108, and/or a surface of the backing 102. In one implementation, the one or more features 120, 302, and 802 increase or decrease a friction of the portion of the surface of the cover 104, the one or more membranes 106, 108, and/or the backing 102 based on the shape and/or the orientation of the one or more features 120, 302, and 802. In another implementation, the one or more features 120, 302, and 802 guide the location or direction of the implement or engage the implement as it is moved within the holster 100.

In various embodiments, the one or more molded-in features 120, 302, and 802 determine a retention of the holster 100. For example, the location, shape, and orientation of the features 120, 302, and 802 can facilitate or inhibit the ease with which the implement moves out of the holster 100, including decreasing or increasing the force needed to remove the implement from the holster 100. In such embodiments, the retention of the holster 100 may be tuned by altering physical characteristics of the features 120, 302, and 802, including the size, shape, spacing, location, orientation, quantity, area, etc. of the features 120, 302, and 802. In various embodiments, forming the backing 102, one or more of the membranes 106, 108, and/or the cover 104 using an injection molding process allows the physical characteristics of the features 120, 302, and 802 to be fully customized and tuned for the desired retention and/or guide results.

In one embodiment as shown in FIGS. 1-5, features 120 are arranged on an attachment portion of the backing 102, adding friction and assisting in reducing movement of the holster 100 when it is attached to an article or garment of the user (i.e., increasing the grip of the holster on the garment or article of the user). Features 120 include protrusions extending from the surface and/or cavities into the surface of the backing 102. The illustration of features 120 is not intended to be limiting. The protrusions and/or cavities of the features 120 may have various shapes (e.g., pointed, rounded, blunted, rectangular, etc.), sizes, layout, arrangement, spacing, and quantities, and may be oriented at various angles with respect to the surface of the backing 102 to achieve desired friction results. In other words, orienting includes that the protrusions extend from the surface of the backing 102 (and/or one or more of the membranes 106, 108 and/or the cover 104) at an angle, rather than perpendicular to the surface of the backing 102 (and/or one or more of the membranes 106, 108 and/or the cover 104).

In various embodiments, different portions of a surface of the backing 102, one or more of the membranes 106, 108 and/or the cover 104 may be molded with different features 120, 302, and/or 802, resulting in different coefficients of friction on the different portions. For example, in one embodiment, the one or more molded-in features 120, 302, and/or 802 includes a first set of molded-in features 120, 302, and/or 802 having a first coefficient of friction based on a first shape and a first orientation of the first set of molded-in features 120, 302, and/or 802, and one or more additional sets of molded-in features 120, 302, and/or 802 having other coefficients of friction based on other shapes and other orientations of the one or more additional sets of molded-in features 120, 302, and/or 802.

In alternate implementations, the features 120, 302, and 802 may include various shapes molded into the cover 104, one or more of the membranes 106, 108, and/or the backing 102, and remain within the scope of the disclosure. For example, the features 302 may include tabs, grooves, notches, bumps, etc. located at various portions of the holster 100 for guiding the implement during holstering, or for improving retention when the implement is holstered.

Figure 8:
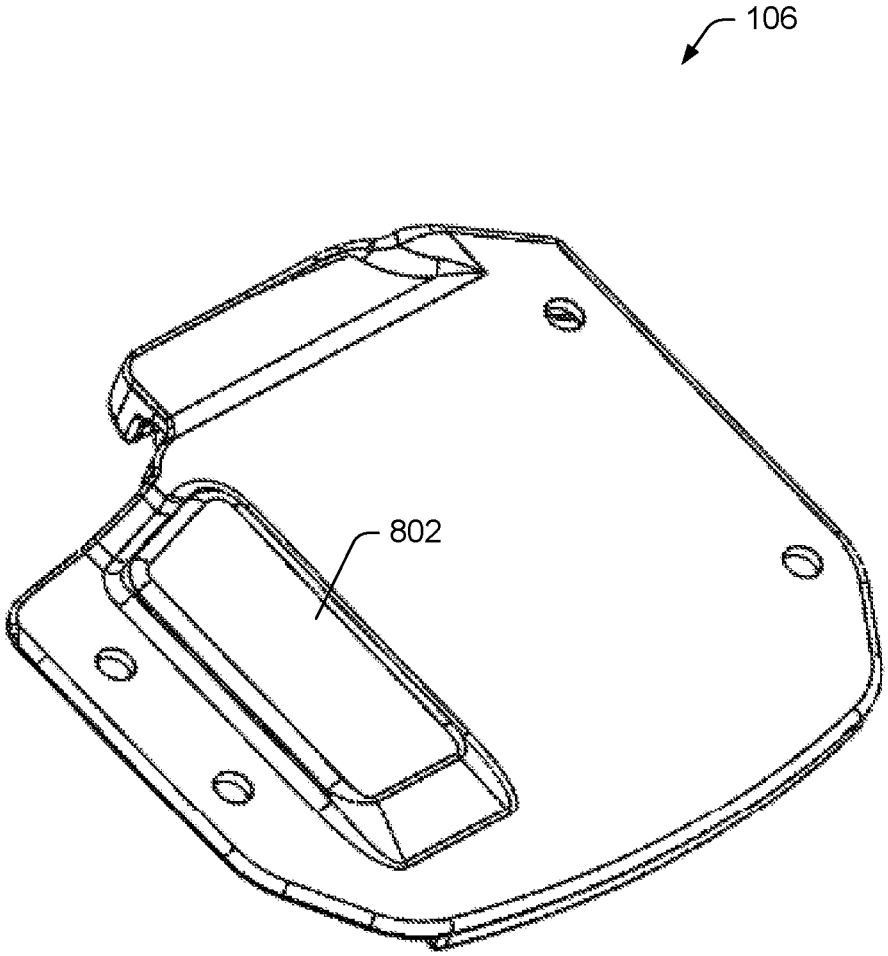
FIG. 8 is a perspective view of an example retention membrane, showing an example molded feature, according to an embodiment.

In an implementation, the holster 100 includes one or more molded features 302, 802 on the backing 102, one or more of the membranes 106, 108, and/or the cover 104 for guiding the implement during holstering, or for improving retention when the implement is holstered. For example, in an implementation as shown in FIGS. 4 and 5, the cover 104 includes molded features 302 comprising a molded protrusion at the entrance of the holster 100 for alignment and or guidance when holstering/reholstering the implement. In another implementation, as shown in FIG. 8, one or more of the membranes 106, 108 includes one or more molded features 802 for alignment and/or retention of the implement, and to prevent the implement from shifting position within the holster. For instance, the one or more features 802 can hold the implement in place and prevent the implement from rotating within the holster or otherwise changing an orientation or position within the holster while the implement is holstered. In some embodiments, the features 302 are located (e.g., on the backing 102, one or more of the membranes 106, 108, and/or the cover 104) and/or shaped to engage various parts of the implement during reholstering and/or while the implement is holstered. In the case of a handgun, for instance, one or more features 302 and/or 802 may be located and/or shaped to engage the barrel, slide, safety, and/or trigger guard of the handgun for guiding the handgun during holstering, or for improving retention when the handgun is holstered.

The components and techniques discussed herein with respect to the backing 102, membranes 106, 108, the cover 104, and the holster 100 are intended to be used in the production of new holsters or in the retro-fitting of existing holsters. In various embodiments, existing holsters may be upgraded or re-fitted with one or more of the components (e.g., backing 102, cover 104, membrane(s) 106, 108, mounting fixture 114, features 120, 302, etc.) and/or using one or more of the described techniques either individually or in various combinations. In an embodiment, the use of the described components and techniques result in modular holsters 100 that are capable of interchangeable backings 102, covers 104, mounting fixtures 114, bushings 112, fasteners 116, 118, and/or the like. Further, such modular holsters 100 may be configured and/or adjusted for various user wearing or carry options and locations.

As discussed above, the techniques, components, and devices described herein with respect to the implementations are not limited to the illustrations of FIGS. 1-6, and may be applied to other holster devices, and case designs, without departing from the scope of the disclosure. In some cases, additional or alternative components, techniques, sequences, or processes may be used to implement the techniques described herein. Further, the components and/or techniques may be arranged and/or combined in various combinations, while resulting in similar or approximately identical results. It is to be understood that a backing 102 and membrane 106 combination may be implemented as a stand-alone device or as part of another system (e.g., integrated with other components to form a holster 100, as described above). In various implementations, additional or alternative components may be used to accomplish the disclosed techniques and arrangements.

Representative Process

Figure 7:
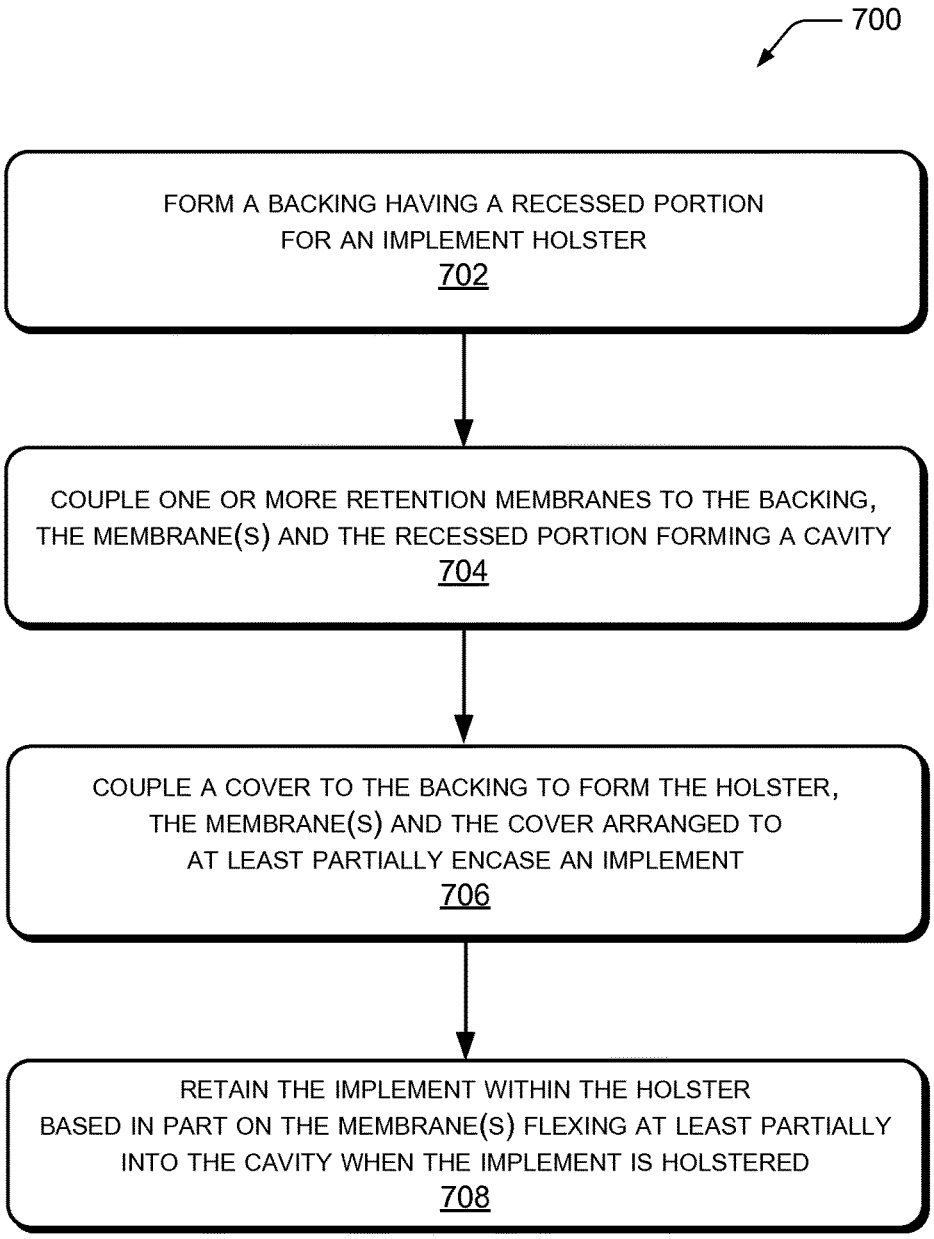
FIG. 7 illustrates a flow diagram of a method of forming a holster assembly, according to an implementation.

FIG. 7 is a flow diagram illustrating an example method 700 for forming a holster (such as holster 100, for example), according to various implementations. The process 700 is described with reference to FIGS. 1-6.

The order in which the process is described is not intended to be construed as a limitation, and any number of the described process blocks can be combined in any order to implement the process, or alternate processes. Additionally, individual blocks may be deleted from the process without departing from the spirit and scope of the subject matter described herein. Furthermore, the process can be implemented in any suitable materials, or combinations thereof, without departing from the scope of the subject matter described herein.

At block 702, the process includes forming a backing (such as backing 102, for example) having a recessed portion (such as recessed portion 202, for example) for an implement holster (such as holster 100, for example). At block 704, the process includes coupling a retention membrane (such as membrane 106, for example) to the backing. In an implementation, the process includes coupling multiple retention membranes (such as membranes 106, 108, for example) to the backing. In an embodiment, the membrane(s) and the recessed portion form a cavity (such as cavity 204, for example).

At block 706, the process includes coupling a cover (such as cover 104, for example) to the backing to form the holster. In an implementation, the membrane(s) and the cover are arranged to at least partially encase an implement. In an embodiment, the process includes spacing the cover from the backing via one or more spacers and/or tensioners, and tuning a retention of the holster via the spacers and/or tensioners. In one example, the process includes user-tuning the retention of the holster by adjusting and/or replacing the spacers and/or tensioners.

In an implementation, the process includes removeably coupling the cover to the backing in a modular fashion. In the implementation, one of many covers may be coupled to and removed from the backing interchangeably. For example, in an implementation, the process includes successively interchanging one or more modular covers with the cover, to at least partially encase one or more different implements.

At block 708, the process includes retaining the implement within the holster based in part on the membrane(s) flexing at least partially into the cavity when the implement is holstered. For example, in an embodiment, the process includes extending or flexing the membrane(s) into the cavity as the implement is inserted into the holster. In the embodiment, the membrane(s) push back against the implement, being in tension, and retain the implement within the holster.

In an implementation, the process includes releaseably coupling an adjustable paddle, belt slide, or modular coupler to the backing for securing the holster to an article or garment of a user in one of multiple configurations. In another implementation, the process includes interchanging one of the paddle, belt slide, or modular coupler by the user with another of the paddle, belt slide, or modular coupler to secure the holster to an article or garment of the user in a different configuration.

In an implementation, the process includes forming the backing, one or more membranes, cover, paddle, belt slide, and/or modular coupler via injection molding and tuning a flexibility, a rigidity, and a stability of the backing, membrane(s), cover, paddle, belt slide, and/or modular coupler based on selecting a plastic material and a thickness of the backing, membrane(s), cover, paddle, belt slide, and/or modular coupler.

In an implementation, the process includes molding one or more features (such as features 120 and/or 302, for example) having preselected shapes and orientations onto a surface of the backing and/or a surface of the cover. In the implementation, the one or more features are arranged to increase or decrease a friction of the surface of the backing and/or the surface of the cover and/or to engage a portion of the implement during holstering and/or while the implement is holstered, based on the shapes and/or the orientations of the one or more features. Additionally or alternately, the process includes molding one or more features having preselected shapes and orientations onto a surface of one or more membranes. In various implementations, the one or more features comprise one or more protrusions and/or cavities arranged at a preselected orientation and having a preselected shape.

In an implementation, the process includes increasing or decreasing a retention of the holster based on a shape and/or an arrangement of the features. In another implementation, the process includes tuning a friction of a surface of the backing, one or more membranes, and/or the cover by molding a plurality of molded-in features onto or into the surface of the backing, the membrane(s), and/or the cover. In an implementation, the process includes forming multiple sets of features on the backing, membrane(s) and/or the cover, each set of features having a different coefficient of friction based on a shape and an orientation of the set of features.

In an implementation, the process includes molding fasteners (such as fasteners 116, 118) located to couple the cover to the backing into the backing and/or the cover. In another implementation, the process includes molding the spacers and/or tensioners into the backing and/or the cover. In a further implementation, the process includes injection molding a shape of at least a portion of the implement into the cover and/or the backing to conform the holster to the implement.

In alternate implementations, other techniques may be included in the process 700 in various combinations, and remain within the scope of the disclosure.

CONCLUSION

While various discreet embodiments have been described throughout, the individual features of the various embodiments may be combined to form other embodiments not specifically described. The embodiments formed by combining the features of described embodiments are also within the scope of the disclosure.

What is claimed is:

1. An apparatus, comprising: a backing for an implement holster, the backing including a recessed portion and one or more cover fastener locations; and a retention membrane coupled to the backing, the recessed portion and the retention membrane forming a first cavity and the retention membrane arranged to form a second cavity with a cover, the retention membrane arranged to flex partially into the first cavity when an implement is encased within the second cavity.

2. The apparatus of claim 1, further comprising an adjustable paddle, belt slide, or modular mounting component releasably and interchangeably coupled to the backing and arranged to secure the holster to an article or garment of a user in multiple configurations.

3. The apparatus of claim 1, further comprising one or more releasable fasteners arranged to removeably couple one of a multiplicity of covers to the backing in a modular fashion, to carry one of a multiplicity of implements with the holster.

4. The apparatus of claim 1, further comprising one or more features molded into at least a portion of a surface of the backing, the one or more features increasing or decreasing a friction of the portion of the surface of the backing based on a shape and/or an orientation of the one or more features.

5. The apparatus of claim 1, further comprising one or more additional membranes, and wherein the retention membrane and/or one or more of the additional membranes comprise a flexible or semi-flexible layer, the retention membrane and/or the one or more additional membranes partly determining a retention for the holster.

6. The apparatus of claim 5, wherein one or more of the additional membranes comprises a spring-type metal layer, comprising stainless steel, titanium, or an alloy.

7. The apparatus of claim 1, wherein the backing comprises an injection molded plastic material, and has flexibility and stability properties based on a plastic material selected.

8. An implement holster, comprising:

a first shell component comprising a backing, the backing including a recessed portion;

one or more retention membranes coupled to the backing, the recessed portion and the one or more retention membranes forming a first cavity; and a second shell component comprising a cover, the cover releaseably coupled to the backing, the cover and the one or more membranes forming a second cavity for encasing at least a portion of a holstered implement, the one or more membranes extending at least partially into the first cavity when the implement is holstered within the second cavity, between the second shell component and the one or more retention membranes.

9. The holster of claim 8, further comprising one or more interchangeable shell sections arranged to be releaseably coupled to the backing and interchanged with the second shell component to encase at least a portion of one or more different implements.

10. The holster of claim 8, further comprising a removable paddle, belt slide, or modular coupler coupled to the backing and arranged to secure the holster to an article or garment of a user, or to an object of furniture or a vehicle.

11. The holster of claim 10, wherein the paddle, belt slide, or modular coupler is adjustable to change a relative position of the holster with respect to the paddle, belt slide, or modular coupler, including forward, neutral, and reverse carry positions.

12. The holster of claim 8, further comprising one or more spacers located at attachment points between the first shell component and the second shell component, and arranged to space the second shell component from the first shell component and to determine a retention of the holster.

13. The holster of claim 12, wherein the spacers comprise adjustable tension devices arranged to be user-adjusted to determine the retention of the holster.

14. The holster of claim 8, further comprising one or more molded-in features arranged on at least one of: a surface of the first shell component, one or more of the retention membranes, and a surface of the second shell component, the one or more molded-in features increasing or decreasing a friction of the surface of the first shell component, the one or more retention membranes, and the surface of the second shell component based on a shape and an orientation of the one or more molded-in features.

15. The holster of claim 14, wherein the one or more molded-in features are arranged to engage a portion of the implement during holstering and/or while the implement is holstered, to facilitate holstering, to prevent the implement from shifting position within the holster, and/or to retain the implement within the holster while holstered.

16. The holster of claim 8, wherein the first shell component and/or one or more of the retention membranes comprise injection molded plastic components formed to include predetermined flexibility and stability characteristics, based on a plastic material selected and a thickness of the first shell component and/or the one or more retention membranes.

17. The holster of claim 8, wherein the second shell component comprises a removable, modular plastic shell section formed using an injection molding process to conform to a shape of at least a portion of the implement.

18. The holster of claim 8, wherein one or more of the retention membranes comprises a spring-type metal layer, comprising stainless steel, titanium, or an alloy.

19. A method, comprising:

forming a backing having a recessed portion, for an implement holster;

coupling a retention membrane to the backing, the membrane and the recessed portion forming a first cavity;

coupling a cover to the backing to form the holster, the membrane and the cover forming a second cavity arranged to encase at least a portion of an implement; and retaining the implement within the holster based in part on the membrane flexing at least partially into the first cavity when the implement is holstered within the second cavity.

20. The method of claim 19, further comprising successively interchanging one or more modular covers with the cover, to at least partially encase one or more different implements.

21. The method of claim 19, further comprising releaseably coupling an adjustable paddle, belt slide, or modular coupler to the backing for securing the holster to an article or garment of a user in one of multiple configurations.

22. The method of claim 21, further comprising interchanging the paddle, belt slide, or modular coupler by the user with another of the paddle, belt slide, or modular coupler to secure the holster to an article or garment of the user in a different configuration.

23. The method of claim 21, further comprising forming the backing, cover, paddle, belt slide, and/or modular coupler via injection molding and tuning a flexibility, a rigidity, and a stability of the backing, cover, paddle, belt slide, and/or modular coupler based on selecting a plastic material and a thickness of the backing, cover, paddle, belt slide, and/or modular coupler.

24. The method of claim 19, further comprising spacing the cover from the backing via one or more spacers and/or tensioners, and tuning a retention of the holster via the spacers and/or tensioners.

25. The method of claim 19, further comprising coupling one or more additional membranes to the backing, and retaining the implement within the holster based in part on the one or more additional membranes flexing at least partially into the first cavity when the implement is holstered.

26. The method of claim 19, further comprising molding one or more features having preselected shapes and orientations onto a surface of at least one of the backing, a surface of the membrane, and a surface of the cover, the one or more features arranged to increase or decrease a friction of the surface of the backing, the surface of the membrane, and the surface of the cover and to engage a portion of the implement during holstering and while the implement is holstered, based on the shapes and the orientations of the one or more features.

27. The method of claim 26, wherein the one or more features are arranged to increase a retention of the implement within the holster and to prevent the implement from shifting position within the holster.

* * * * *